US011969130B2

(12) United States Patent
Kim et al.

(10) Patent No.: US 11,969,130 B2
(45) Date of Patent: Apr. 30, 2024

(54) RACK ASSEMBLY AND DISH WASHER COMPRISING THE SAME

(71) Applicant: Samsung Electronics Co., Ltd., Suwon-si (KR)

(72) Inventors: Jusik Kim, Suwon-si (KR); Kitae Park, Suwon-si (KR); Daeseon Yeom, Suwon-si (KR); Junho Lee, Suwon-si (KR); Minho Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 82 days.

(21) Appl. No.: 17/548,362

(22) Filed: Dec. 10, 2021

(65) Prior Publication Data

US 2022/0133124 A1 May 5, 2022

Related U.S. Application Data

(63) Continuation of application No. PCT/KR2021/014619, filed on Oct. 19, 2021.

(30) Foreign Application Priority Data

Nov. 2, 2020 (KR) ..... 10-2020-0144438

(51) Int. Cl.
*A47L 15/50* (2006.01)

(52) U.S. Cl.
CPC ..... *A47L 15/502* (2013.01); *A47L 15/507* (2013.01)

(58) Field of Classification Search
None
See application file for complete search history.

(56) References Cited

U.S. PATENT DOCUMENTS

| | | | |
|---|---|---|---|
| 7,682,465 | B2 | 3/2010 | Anderson et al. |
| 10,743,742 | B2 | 8/2020 | Buesing et al. |
| 11,000,179 | B2 | 5/2021 | Buesing et al. |
| 2012/0056519 | A1 | 3/2012 | Woo et al. |

(Continued)

FOREIGN PATENT DOCUMENTS

| | | | |
|---|---|---|---|
| CN | 202341985 | U | 7/2012 |
| CN | 105496336 | A | 4/2016 |

(Continued)

OTHER PUBLICATIONS

International Search Report and Written Opinion of the International Searching Authority in connection with International Application No. PCT/KR2021/014619 dated Jan. 26, 2022, 14 pages.

*Primary Examiner* — Rita P Adhlakha

(57) ABSTRACT

A rack assembly of a dish washer is disclosed. A rack assembly of a dish washer according to an embodiment of the disclosure includes a frame including a plurality of wires separately arranged on a bottom surface configured to house cutlery, and a plurality of tine blocks detachable from the plurality of wires, each of the plurality of tine blocks respectively includes a holding surface supporting the cutlery, and a plurality of tines formed on the holding surface, wherein the plurality of tine blocks include a first time block including a plurality of first tines separately arranged by a first interval in a first direction, and a second tine block including a plurality of tines separately arranged by a second interval narrower than the first interval in the first direction.

20 Claims, 14 Drawing Sheets

(56) References Cited

U.S. PATENT DOCUMENTS

| | | | | |
|---|---|---|---|---|
| 2013/0002107 | A1 | 1/2013 | Paschini et al. | |
| 2018/0206701 | A1* | 7/2018 | Ko | A47L 15/503 |
| 2019/0343368 | A1 | 11/2019 | Buesing et al. | |
| 2020/0352409 | A1 | 11/2020 | Buesing et al. | |
| 2021/0393108 | A1* | 12/2021 | Harr | A47L 15/503 |

FOREIGN PATENT DOCUMENTS

| | | | |
|---|---|---|---|
| EP | 2554097 | A2 | 2/2013 |
| JP | 06000049 | Y2 | 1/1994 |
| JP | 11-332809 | A | 12/1999 |
| JP | 2003-284671 | A | 10/2003 |
| JP | 2009-219530 | A | 10/2009 |
| KR | 10-1290375 | B1 | 7/2013 |
| KR | 10-2019-0129325 | A | 11/2019 |

* cited by examiner

RACK ASSEMBLY AND DISH WASHER COMPRISING THE SAME

CROSS-REFERENCE TO RELATED APPLICATIONS

This application is a continuation of International Application No. PCT/KR2021/014619 filed on Oct. 19, 2021, which is based on and claims priority under 35 U.S.C. § 119(a) to Korean Patent Application No. 10-2020-0144438, filed on Nov. 2, 2020, in the Korean Intellectual Property Office, the disclosures of which are herein incorporated by reference in their entirety.

BACKGROUND

1. Field

The disclosure relates to a rack assembly and a dish washer including the same, and more particularly, to a rack assembly including a plurality of tine blocks wherein intervals of the plurality of tines are different and which is detachable, and a dish washer including the same.

2. Description of the Related Art

A dish washer is a device that washes dishes by spraying high-pressure washing water to dishes, and components of a general dish washer include a machine room including a sump and a washing pump, etc., a washing tub wherein washing is performed, a rack assembly supporting a subject for washing, and a spraying nozzle spraying wash water, etc., and washing water sprayed from the spraying nozzle by the washing pump washes a subject for washing.

A dish washer may wash various subjects for washing including not only dishware such as dishes, plates, and cups and cooking tools such as pots, pans, etc., but also cutlery including spoons, forks, knives, etc., and each subject for washing should be fixed such that it is not detached during washing by ribs, tines, etc. which are fixing members of a rack assembly. Thus, a rack assembly that houses subjects for washing and supports them should have a structure for effectively housing subjects for washing and stably fixing them in consideration of subjects for washing that are housed.

In particular for cutlery, there is a limitation on holding and fixing a large amount of cutlery by a fixing member fixing dishes, plates, etc., and a dish washer may include a separate cutlery holding area in some areas or all areas inside a rack assembly to house cutlery. However, depending on users of a dish washer, there are differences in the types, sizes, and individual number of cutlery to be washed, and accordingly, a technical need for a rack assembly that can effectively house and fix cutlery in accordance with a use environment of cutlery of a user has existed.

SUMMARY

The disclosure is for resolving the aforementioned problems, and the purpose of the disclosure is in providing a rack assembly including a plurality of tine blocks wherein intervals of the plurality of tines are different and detachable, and a dish washer including the same.

A rack assembly of a dish washer according to an embodiment of the disclosure includes a frame including a plurality of wires separately arranged on a bottom surface configured to house cutlery, and a plurality of tine blocks detachable from the plurality of wires, each of the plurality of tine blocks respectively include a holding surface supporting the cutlery and a plurality of tines formed on the holding surface, wherein the plurality of tine blocks include a first time block including a plurality of first tines separately arranged by a first interval in a first direction, and a second tine block including a plurality of second tines separately arranged by a second interval narrower than the first interval in the first direction.

In this case, in the second tine block, a width in the first direction and a width in a second direction perpendicular to the first direction may be respectively identical to a width in the first direction and a width in the second direction of the first tine block based on the bottom surface.

Meanwhile, in the plurality of tine blocks, a tine arranged at an end in the first direction among the plurality of tines may be separately arranged by a predetermined interval from an end part of the holding surface.

Meanwhile, the plurality of tine blocks includes adjacent tine blocks coupled to the plurality of wires, and two adjacent tines on contacting surfaces of the adjacent tine blocks may be separated by the first interval.

Meanwhile, the plurality of tine blocks may respectively include a hook detachable from the plurality of wires, and a guide member configured to, based on the hook being coupled to the plurality of wires, adhere to the plurality of wires and fix the plurality of tine blocks.

Meanwhile, shapes of the plurality of first tines of the first tine block may be different from shapes of the plurality of second tines of the second tine block.

Meanwhile, the plurality of tine blocks may include a third tine block including a plurality of third tines separately arranged by a third interval different from the first interval and the second interval in the first direction, and in the third tine block, a width in the first direction and a width in a second direction perpendicular to the first direction may be respectively identical to a width in the first direction and a width in the second direction of the first tine block based on the bottom surface.

Meanwhile, at least a part of the bottom surface of the frame may have a shape that is tilted in relation to a second direction perpendicular to the first direction, and the rack assembly may include a supporting block detachable from the plurality of wires, and configured to support the cutlery and prevent the cutlery from slipping in the second direction.

Meanwhile, the rack assembly may include a partitioning block detachable from the plurality of wires, and configured to partition the bottom surface of the frame.

Meanwhile, the rack assembly may include a small basket detachable from the plurality of wires, and the small basket may include a housing that forms an outer rim and configured to hold an object for washing, and a plurality of fixing projections continuously arranged in the first direction on a top surface of the housing.

Meanwhile, the plurality of tine blocks may include a fourth tine block including a plurality of fourth tines separately arranged by the first interval in the first direction, and in the fourth tine block, a width in the first direction may be longer than a width in the first direction of the first tine block based on the bottom surface.

Meanwhile, the plurality of tine blocks may include a plurality of holding surfaces separately arranged from one another, and the plurality of tines may be separately arranged on respective holding surfaces.

Meanwhile, a dish washer according to an embodiment of the disclosure includes a main body; a washing tub is provided inside of the main body, an upper basket arranged in an upper end of the washing tub, and includes a frame including a plurality of wires separately arranged on a bottom surface configured to house cutlery, and a plurality of tine blocks detachable from the plurality of wires, each of the plurality of tine blocks respectively includes a holding surface supporting the cutlery, and a plurality of tines formed on the holding surface, wherein the plurality of tine blocks include a first tine block including a plurality of first tines separately arranged by a first interval in a first direction, and a second tine block including a plurality of second tines separately arranged by a second interval narrower than the first interval in the first direction.

In this case, in the second tine block, a width in the first direction and a width in a second direction perpendicular to the first direction may be respectively identical to a width in the first direction and a width in the second direction of the first tine block based on the bottom surface.

Meanwhile, in the plurality of tine blocks, a tine arranged at an end in the first direction among the plurality of tines may be separately arranged by a predetermined interval from an end part of the holding surface.

Meanwhile, the plurality of tine blocks may include adjacent tine blocks coupled to the plurality of wires, and two adjacent tines, on contacting surfaces of the adjacent tine blocks, may be separated by the first interval.

Meanwhile, the plurality of tine blocks may respectively include a hook detachable from the plurality of wires, and a guide member configured to, based on the hook being coupled to the plurality of wires, adhere to the plurality of wires and fix the plurality of tine blocks.

Meanwhile, shapes of the plurality of tines of the first tine block are different from shapes of the plurality of tines of the second tine block.

Meanwhile, the plurality of tine blocks may include a third tine block including a plurality of third tines separately arranged by a third interval different from the first interval and the second interval in the first direction, and in the third tine block, a width in the first direction and a width in the second direction perpendicular to the first direction may be respectively identical to a width in the first direction and a width in the second direction of the first tine block based on the bottom surface.

Meanwhile, at least a part of the bottom surface of the upper basket may have a shape that is tilted in a second direction perpendicular to the first direction, and the rack assembly may include a supporting block detachable from the plurality of wires, and configured to support the cutlery and prevent the cutlery from slipping in the second direction.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
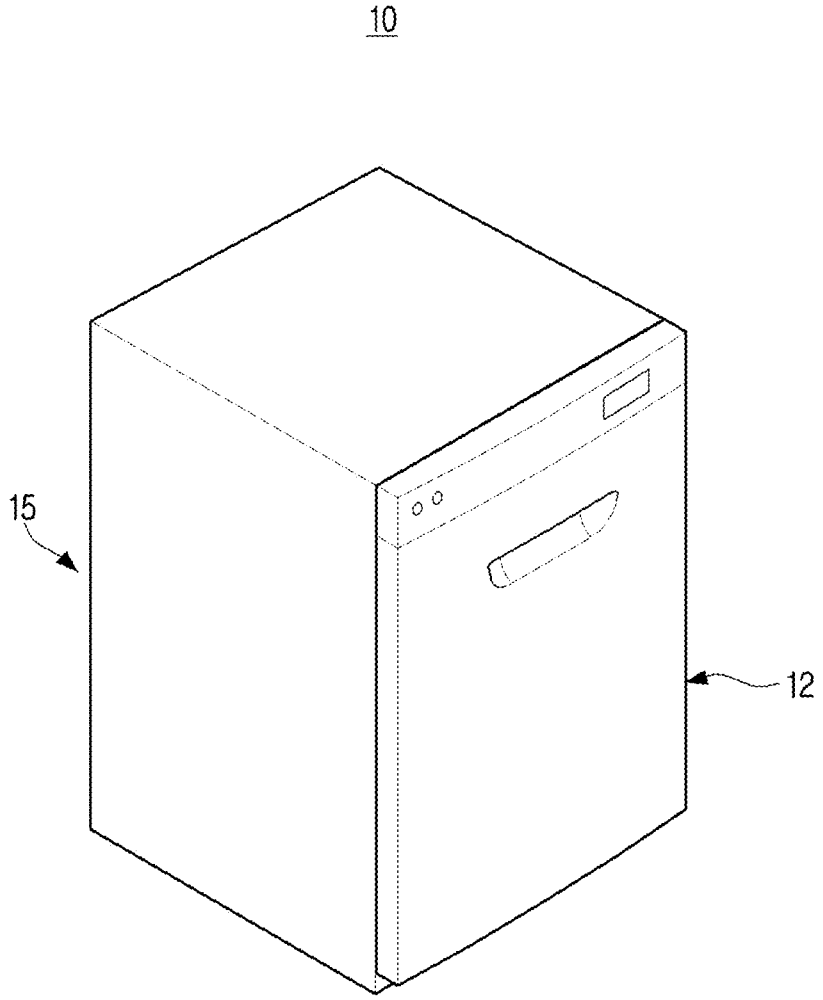
FIG. 1 is a perspective view of a dish washer according to an embodiment of the disclosure.

FIGS. 1 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The embodiments that will be described below are exemplary embodiments for promoting understanding of the disclosure, and it should be understood that the disclosure may be implemented while being modified in various forms, unlike the embodiments described herein. Meanwhile, in explaining the disclosure, in case it is determined that detailed explanation of related known functions or features may unnecessarily confuse the gist of the disclosure, the detailed explanation and detailed illustration thereof will be omitted. Also, in the accompanying drawings, some components may not be illustrated in their actual scales, but may be illustrated in more enlarged sizes than their actual sizes, for promoting understanding of the disclosure.

Also, as terms used in this specification and the claims, general terms were selected in consideration of the functions described in the disclosure. However, the terms may vary depending on the intention of those skilled in the art who work in the pertinent field, legal or technical interpretation, or emergence of new technologies, etc. Also, there are some terms that were designated by the applicant on his own, and in such cases, the meaning of the terms may be interpreted as defined in this specification. Meanwhile, if there is no specific definition of the terms, the meaning of the terms may be interpreted based on the overall content of this specification and technical knowledge common in the pertinent technical field.

In addition, in the description of the disclosure, the order of each step should be understood in a nonrestrictive way, unless a preceding step should necessarily be performed prior to a subsequent step in a logical and temporal sense. That is, excluding an exceptional case as above, even if a process described as a subsequent step is performed prior to a process described as a preceding step, there would be no influence on the essence of the disclosure, and the scope of the disclosure should also be defined regardless of the orders of steps.

Further, in this specification, expressions such as "have," "may have," "include," and "may include" denote the existence of such characteristics (e.g.: elements such as numbers, functions, operations, and components), and do not exclude the existence of additional characteristics.

Also, terms such as "first," "second" and the like may be used to describe various elements, but the elements should not be limited by the terms. Such terms may be used only to distinguish one element from another element. For example, a first element may be called a second element, and a second element may be called a first element in a similar manner, without departing from the scope of protection of the disclosure.

In addition, terms such as 'outer circumferential surface,' 'inner circumferential surface,' 'top surface,' 'bottom surface,' 'side surface,' 'left side,' 'right side,' 'upper part,' 'lower part,' 'area' and the like used in the disclosure were defined based on the drawings, and the shapes and locations of respective elements are not limited by these terms.

Also, in this specification, elements necessary for description of each embodiment of the disclosure were explained, and thus elements are not necessarily limited thereto. Accordingly, some elements may be modified or omitted, or other elements may be added. In addition, elements may be arranged while being dispersed to devices independent from one another.

Further, while the embodiments of the disclosure will be described in detail with reference to the following accompanying drawings and the content described in the accompanying drawings, it is not intended that the disclosure is restricted or limited by the embodiments.

Hereinafter, the disclosure will be described in more detail with reference to FIG. 1 to FIG. 6B.

FIG. 1 is a perspective view of a dish washer 10 according to an embodiment of the disclosure.

Referring to FIG. 1, the dish washer 10 may include a main body 15 forming the exterior, and a door 12 that closes or opens the inside of the main body 15.

The dish washer 10 is a device that sprays washing water to subjects for washing such as dishware, etc. to wash them, and it may be classified into various types according to the structure and the arrangement type of the main body 15. As types of the dish washer 10, there may be a dish washer 10 in a built-in type that is installed in a space that was provided by separating a part of a furniture cabinet which is an external supporter, a free-standing type that can be independently arranged, a counter top type that is arranged on an upper counter of a furniture cabinet, etc., an in-sink type that is manufactured as an integrated type to a sink and installed, etc.

The dish washer 10 illustrated in FIG. 1 is a dish washer 10 in a built-in type that is used for households in general, but the dish washer 10 including a rack assembly 100 of the disclosure is not limited thereto, and the configurations of the disclosure may also be applied to a basket and a rack assembly 100 of a dish washer 10 of another type.

The door 12 has a structure that is installed to be rotatable on the front surface of the main body 15, and in the upper part of the door 12, a controlling device by which a user can control the dish washer 10 may be provided, and a user may manipulate the dish washer 10 while opening or closing the door 12 easily. Inside the door 12, a washing tub 20 may be provided.

Figure 2:
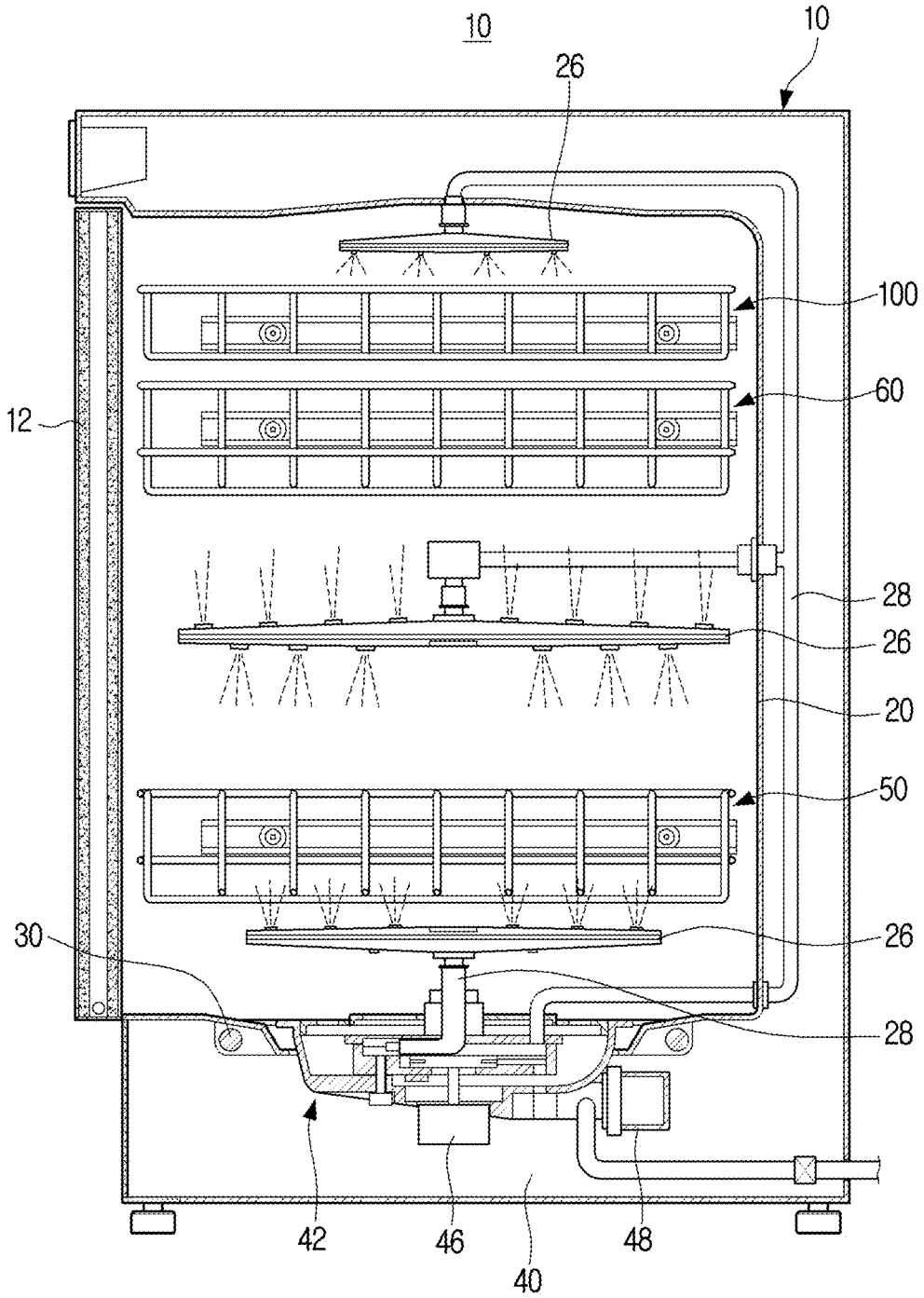
FIG. 2 is a side cross-sectional view of a dish washer according to an embodiment of the disclosure.

FIG. 2 is a side cross-sectional view of the dish washer 10 according to an embodiment of the disclosure.

Referring to FIG. 2, the dish washer 10 may include a washing tub 20, a machine room 40, and rack assemblies 50, 60, 100.

The rack assemblies 50, 60, 100 may be included as a plurality of rack assemblies, and they may respectively be arranged in the upper and lower directions of the washing tub 20. The rack assemblies 50, 60, 100 may house and support subjects for washing, and they may consist of a basket constituted with wires and a fixing member. Also, the rack assemblies 50, 60, 100 may also be referred to as baskets such as an upper basket and a lower basket.

In an embodiment including three rack assemblies 50, 60, 100, the rack assemblies may be classified into a lower rack assembly 50, a middle rack assembly 60, and an upper rack assembly 100 according to the arrangement locations. In the lower rack assembly 50, cooking tools such as pots and pans, or dishware in a big volume may be housed mostly, and in the middle and upper rack assemblies 60, 100, dishware such as dishes and plates, and cutlery may be housed. Meanwhile, the locations of the rack assemblies and subjects for washing housed are not limited thereto, and they may be various.

In particular, the upper rack assembly 100 for housing cutlery is also referred to as a third rack assembly, and its height may be formed to be relatively low and it may mostly house cutlery such as spoons, forks, knives, and chopsticks. Hereinafter, explanation will be made based on the upper rack assembly 100 for the convenience of explanation, but the location is not limited thereto, and the configurations of the disclosure may also be applied to all or some areas of the other rack assemblies 50, 60.

The washing tub 20 is a space provided inside the main body 15, and inside the washing tub 20, the plurality of rack assemblies 50, 60, 100 where dishware subject to washing is held, and a plurality of spraying nozzles 26 may be included.

The spraying nozzles 26 may include an upper spraying nozzle 26 that is provided in the upper part of the upper rack assembly 100 located on the uppermost side and sprays washing water, a middle spraying nozzle 26 that is arranged between the middle rack assembly 60 and the lower rack assembly 50 and sprays washing water to the rack assemblies 50, 60 in the middle and lower parts, and a lower spraying nozzle 26 that sprays washing water to the lower rack assembly 50 in the lower part.

The spraying nozzles 26 are connected with a sump 42 by a duct 28 and are supplied with washing water. The spraying nozzles 26 may have a structure that sprays washing water to several directions in a fixed location. Alternatively, the spraying nozzles 26 may rotate and spray washing water evenly to the plurality of rack assemblies 50, 60, 100.

On the bottom surface of the washing tub 20, a heater 30 that heats washing water may be provided, and in the lower part of the washing tub 20, a machine room 40 may be provided.

Inside the machine room 40, a sump 42 that collects washing water supplied to the inside of the washing tub 20 and pumps the washing water, and moves the washing water to the spraying nozzles 26 is provided.

Also, in the sump 42, a plurality of flow channels and a circulating pump 46 pumping water to the plurality of flow channels are provided, and on one side of the sump 42, a drain pump 48 that discharges polluted washing water to the outside through a drain pipe is provided.

Hereinafter, an operating process of the dish washer 10 constituted as above will be described.

First, if power is applied in a state where objects for washing are housed in the rack assemblies 50, 60, 100 inside the washing tub 20, washing water necessary for washing starts to be supplied to the inside of the washing tub 20 through a washing water supplying hole.

A washing cycle proceeds as the washing water supplied to the inside of the washing tub 20 is collected in the inside of the sump 42 provided in the lower part of the washing tub 20, and then the washing water collected by a pumping operation of the circulating pump 46 inside the sump 42 is supplied to the spraying nozzles 26 through the duct 28, and the washing water is sprayed to the objects for washing housed in the respective rack assemblies 50, 60, 100 at a high pressure.

When the washing cycle is completed, not only the washing water but contaminants smeared on the objects for washing were washed by the washing water and were collected in the sump 42, the washing water including the contaminants is discharged to the outside through the drain pipe according to an operation of the drain pump 48.

When the washing water including the contaminants is discharged to the outside, a rinsing cycle proceeds as clean washing water is collected in the sump 42 again through the washing water supplying hole, and the washing water is sprayed to the objects for washing at a high pressure through the respective spraying nozzles 26 in the same manner as the washing.

When the rinsing cycle is completed, a drying cycle proceeds, and in the drying cycle, the heater 30 is operated and washing water of a high temperature is sprayed to the objects for washing, and in a process where the washing water of a high temperature is vaporized, the washing water is vaporized along with the remaining washing water and the objects for washing are dried. Alternatively, hot wind of a high pressure may be sprayed as a drying cycle. When drying is completed, the washing process is completed.

Figure 3A:
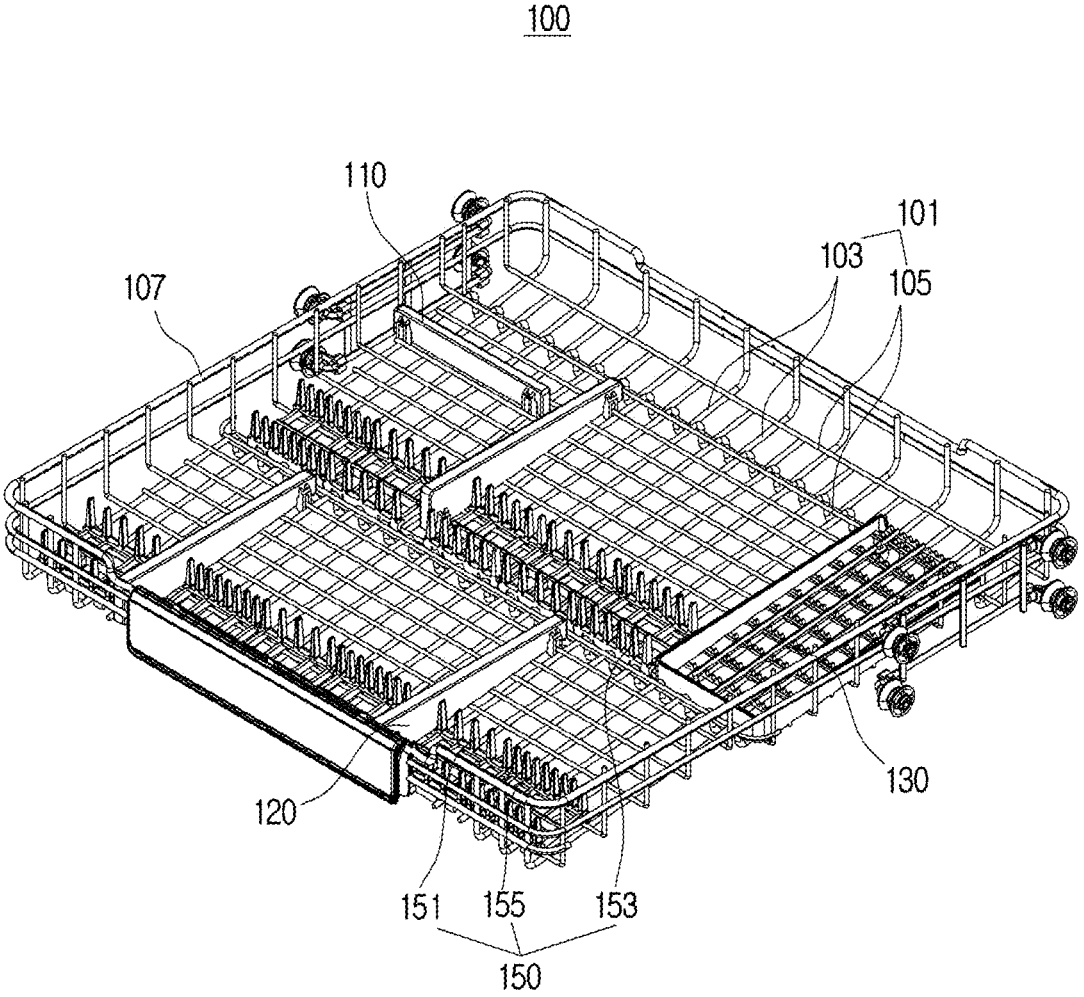
FIG. 3A is a perspective view of a rack assembly according to an embodiment of the disclosure.
Figure 3B:
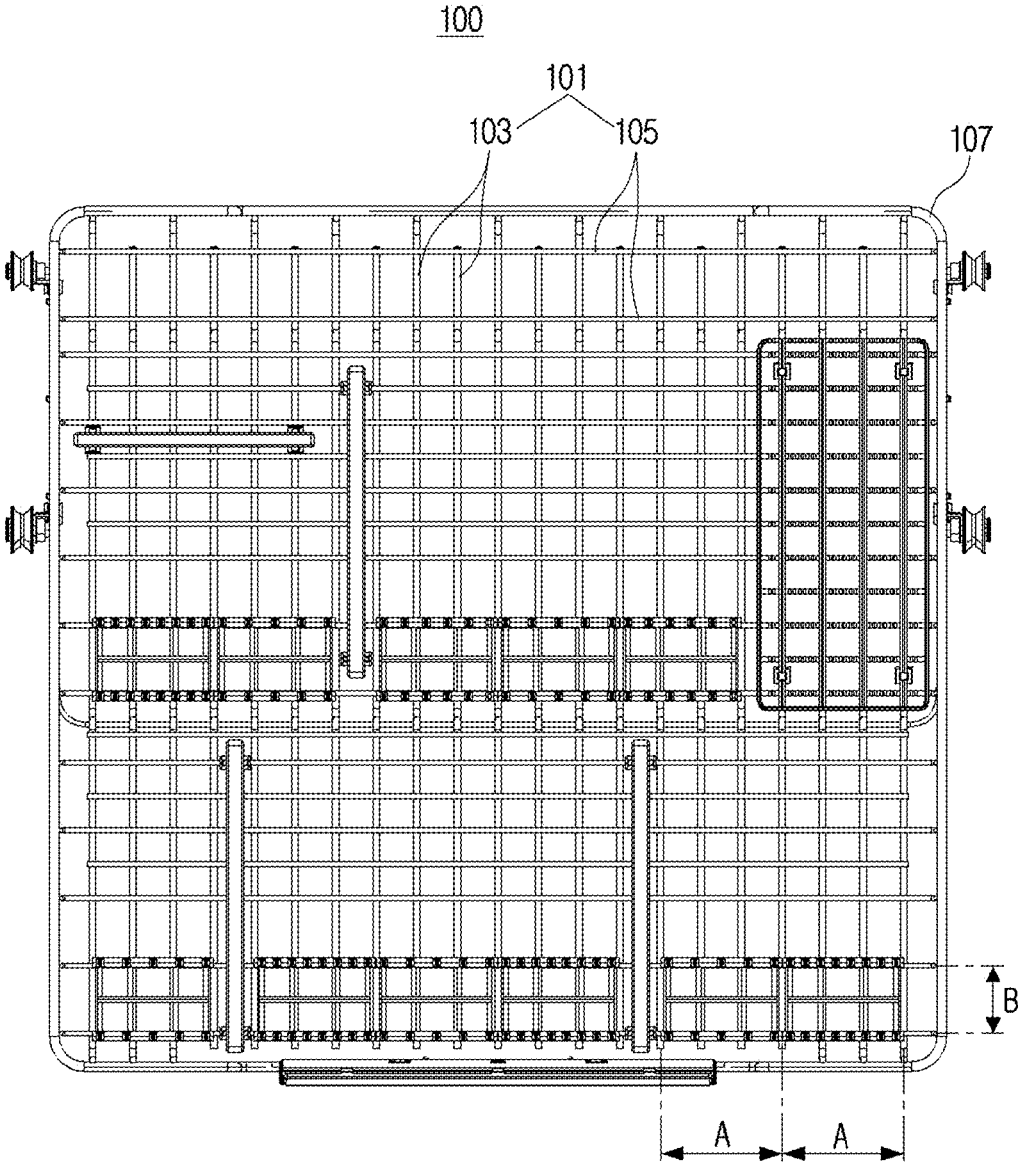
FIG. 3B is a plan view of a rack assembly according to an embodiment of the disclosure.
Figure 3C:
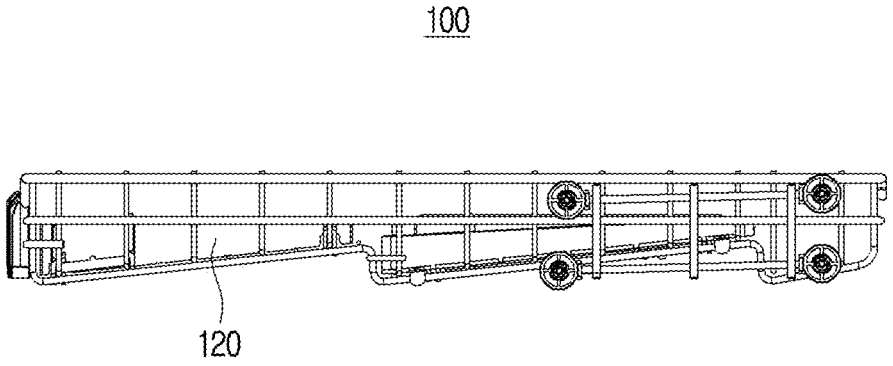
FIG. 3C is a side surface view of a rack assembly according to an embodiment of the disclosure.

FIG. 3A is a perspective view of the rack assembly 100 according to an embodiment of the disclosure, FIB. 3B is a plan view of the rack assembly 100 according to an embodiment of the disclosure, and FIG. 3C is a side surface view of the rack assembly 100 according to an embodiment of the disclosure.

Referring to FIG. 3A to FIG. 3C, the rack assembly 100 may include a frame 107, a plurality of wires 101, and a plurality of tine blocks 150.

The frame 107 forms the exterior of the rack assembly 100, and cutlery may be housed in it. The frame 107 includes a plurality of wires 101 that are separately arranged on the bottom surface, and thus it may have a structure where at least a part of the bottom surface is opened. The frame 107 may be a wire frame 107 consisting of a wire material, and at least some parts of the side surfaces are also opened, and thus the area contacting washing water can be reduced, and interruption of introduction and discharging of washing water can be reduced. On both side surfaces of the frame 107, a plurality of wheels may be included correspondingly to the rail of the washing tub, and on the front surface or the side surfaces of the frame 107, a handle may be provided, and thus a user can move the rack assembly 100 to the outside of the washing tub smoothly and easily.

The plurality of wires 101 may be separately arranged on the bottom surface of the frame 107. The plurality of wires 101 may include a plurality of vertical wires 103 that are separately arranged in a vertical direction based on the bottom surface, and a plurality of horizontal wires 105 that are separately arranged in a horizontal direction perpendicular to the vertical wires 103.

The plurality of wires 101 may support objects for washing such as dishes, plates, and cutlery. In the rack assembly 100 having the configuration as in FIG. 3A, the horizontal wires 105 among the plurality of wires 101 may support objects for washing. As washing water is sprayed and discharged to the object for washing held on the top surfaces of the plurality of wires 101, the bottom surface of the rack assembly 100 may have a limited contacting area such that it does not become an obstacle to the flow of the washing water. Hereinafter, explanation will be made mainly focused on cutlery as the objects for washing, for the convenience of explanation, but the disclosure is not limited thereto, and the rack assembly 100 according to the disclosure can be applied in the same manner for various types of objects for washing.

The frame 107 and the plurality of wires 101 may consist of metal having a high heat transfer rate. In particular, the rack assembly 100 consisting of metal wires may be advantageous for housing washing water of a high temperature in a drying cycle. The frame 107 and the plurality of wires 101 may constitute a basket. Specifically, a basket consisting of the frame 107 and the plurality of wires 101, and a plurality of tine blocks 150 that will be described below, etc. may be coupled to each other and constitute the rack assembly 100.

The plurality of tine blocks 150 may include a holding surface 160 supporting cutlery and a plurality of tines 165 formed on the holding surface 160, and they may be detachable from the plurality of wires 101. The holding surface 160 may be formed on the top surfaces of the tine blocks 150, and the plurality of tines 165 may be formed to extend in the upper end direction from the holding surface.

The holding surface 160 may be formed as a plurality of holding surfaces in two columns or more that are separated from each other inside one tine block 150. The plurality of holding surfaces 160 may be in parallel to each other, and each of the plurality of holding surfaces 160 may include a plurality of tines 165 that extend in the upper direction and are separately arranged. That is, one tine block 150 may include holding surfaces 160 in two columns or more that are separated from each other, and on each holding surface 160, the plurality of tines 165 may be formed to be separately arranged in a first direction. Hereinafter, for the convenience of explanation, the direction where the plurality of tines 165 are separately arranged inside one holding surface 160 will be referred to as the first direction, and a direction perpendicular to the first direction will be referred to as a second direction.

The plurality of tine blocks 150 may support cutlery such as spoons, forks, knives, etc. in a shape of holding them on their side surfaces. The holding surface 160 may support the side surfaces of the cutlery, and the plurality of tines 165 may support the cutlery such that the cutlery does not fall on the front surfaces or rear surfaces, and thus the cutlery may maintain a shape of being put up on the side surfaces during the operation of the dish washer 10. By virtue of this, movement or detachment of the cutlery during a washing process can be prevented and washing force can thereby be improved, and more cutlery can be housed in the rack assembly 100 having the same area.

The plurality of tine blocks 150 may include a first tine block 151 where the plurality of tines 165 are separately arranged by a first interval C1 in the first direction and a second tine block 153 where the plurality of tines 165 are separately arranged by a second interval C2 narrower than the first interval C1 in the first direction. Also, the plurality of tine blocks 150 may further include a third tine block 155 where the plurality of tines 165 are separately arranged by a third interval C3 different from the first interval C1 and the second interval C2 in the first direction.

In the plurality of respective tine blocks 150, the intervals between the holding surfaces 160 and the plurality of tines 165 may be different, and the plurality of tine blocks 150 may fix cutlery in various sizes and shapes correspondingly to the respective structures. The detailed structures of the plurality of tine blocks 150 will be described in detail with reference to FIG. 4A to FIG. 4C.

As the plurality of tine blocks 150 are detachable, some of the plurality of tine blocks 150 may be separated or further coupled depending on needs, and their arrangement may be changed. By the rack assembly 100 in such a do it yourself (DIY) format, a user can change the components of the rack assembly 100 by himself or herself corresponding to an independent use environment of cutlery.

Specifically, cutlery may have various sizes and structures according to users' countries and cultures, and types and sizes of cutlery housed during one time of washing may be diverse. For example, an ideal user may use all of cutlery in various types and sizes in a similar number, but unlike this, a first user may use cutlery in relatively small sizes such as tea spoons, dessert forks, dessert knives, and cutlery for children more, and a second user may use cutlery in relatively big sizes such as kitchen knives, tongs, scoops, serving forks, and serving spoons more, and a third user may mainly use spoons and chopsticks more. Alternatively, cutlery mainly used by a fourth user may be changed by a certain cycle, and the fourth user may use specific cutlery more on a special day. Also, use environments of cutlery may be diverse according to users' dining cultures, and the environments may be changed according to users' use environments.

Meanwhile, in case a fixing member supporting cutlery of the rack assembly 100 is fixed, it may be insufficient to fulfill needs according to use environments of various users. In particular, some of cutlery in types and sizes that occupy a lot of ratios may be held on tines 165 in unsuitable intervals, and accordingly, the cutlery may not be fixed properly and it may move or be detached during washing, and thus the washing performance may be reduced, and the tines 165 may break down. Or, there may be inconvenience of having to operate the dish washer 10 a plurality of times for washing the cutlery. Thus, for the aforementioned first to fourth users, a technical need for adjusting the arrangement structure of cutlery differently in a corresponding manner to their use environments may exist.

In the rack assembly 100, as the plurality of tine blocks 150 where the intervals by which the plurality of tines 165 are separately arranged are different from one another can be freely detached and arranged by a user, the user can couple and arrange appropriate tine blocks 150 to the plurality of wires 101 correspondingly to the types and sizes of cutlery to be washed. Thus, even if a use environment of cutlery is changed, the washing performance can be maintained without being degraded, and the dish washer 10 does not have to be operated a plurality of times, and thus the washing performance and the washing efficiency of the dish washer can be improved.

Referring to FIG. 3B, a width in the first direction and a width in the second direction may be identical to each other based on the bottom surfaces of the plurality of tine blocks 150.

The horizontal length in a horizontal direction of the bottom surfaces of the plurality of tine blocks 150 may be a width A in the first direction, and the vertical length in a vertical direction may be a width B in the second direction. In this case, in the first tine block 151 and the second tine block 153 constituting the plurality of tine blocks 150, in the second tine block 153, a width in the first direction and a width in the second direction A, B may be respectively identical to a width in the first direction and a width in the second direction A, B of the first tine block 151 based on the bottom surface. Also, in the third tine block 155, a width in the first direction and a width in the second direction A, B may be respectively identical to a width in the first direction and a width in the second direction A, B of the first tine block 151 based on the bottom surface.

The width in the first direction and the width in the second direction A, B of the plurality of tine blocks 150 may be set in consideration of the intervals by which the horizontal wires 105 and the vertical wires 103 of the plurality of wires 101 are arranged. For example, as in FIG. 3B, the width A in the first direction of the plurality of tine blocks 150 may be identical or similar to the vertical length of the four vertical wires 103, and the width B in the second direction of the plurality of tine blocks 150 may be implemented to be identical or similar to the horizontal distance of the three horizontal wires 105. That is, the width in the first direction and the width in the second direction A, B of the plurality of tine blocks 150 may be standardized correspondingly to the structures of the plurality of wires 101.

As the width in the first direction and the width in the second direction A, B of the plurality of tine blocks 150 are regular, a user can couple other types of tine blocks 150 in a location where one tine block 150 among the plurality of tine blocks 150 is separated. Thus, a user can easily replace the tine blocks 150 depending on needs even if the use environment is changed, and can change the structure of the rack assembly 100 by replacing minimum tine blocks 150, and restore the structure after use.

In each of the horizontal wires 105 and the vertical wires 103, the intervals by which they are separately arranged may be repeated by a predetermined interval. The plurality of tine blocks 150 have a width in the first direction and a width in the second direction A, B in a corresponding manner thereto, and thus a user can freely arrange the plurality of tine blocks 150 on the bottom surface of the rack assembly 100. For example, the width A in the first direction may correspond to the intervals of the four vertical wires 103, and the width B in the second direction may correspond to the intervals of the three horizontal wires 105, and thus the plurality of tine blocks 150 may be coupled in any locations on the plurality of wires 101.

A user can arrange the plurality of tine blocks 150 by freely changing their locations in consideration of the sizes and the types, and the center of gravity, etc. of cutlery. Accordingly, in the rack assembly 100 of the disclosure, the plurality of tine blocks 150 are arranged freely in a DIY manner, and thus a user can change and adjust the arrangement of the rack assembly 100 correspondingly to the individual use of the user within the living space by himself or herself.

Referring to FIG. 3C, the bottom surface of the rack assembly 100 may have a tilted shape by a predetermined angle in the top surface direction. As the bottom surface of the rack assembly 100 is tilted based on the horizontal surface, washing water can be easily discharged from the rack assembly 100. The rack assembly 100 in a tilted shape may further include a supporting block 110 and a partitioning block 120, and detailed explanation in this regard will be made with reference to FIG. 6A and FIG. 6B.

Figure 4A:
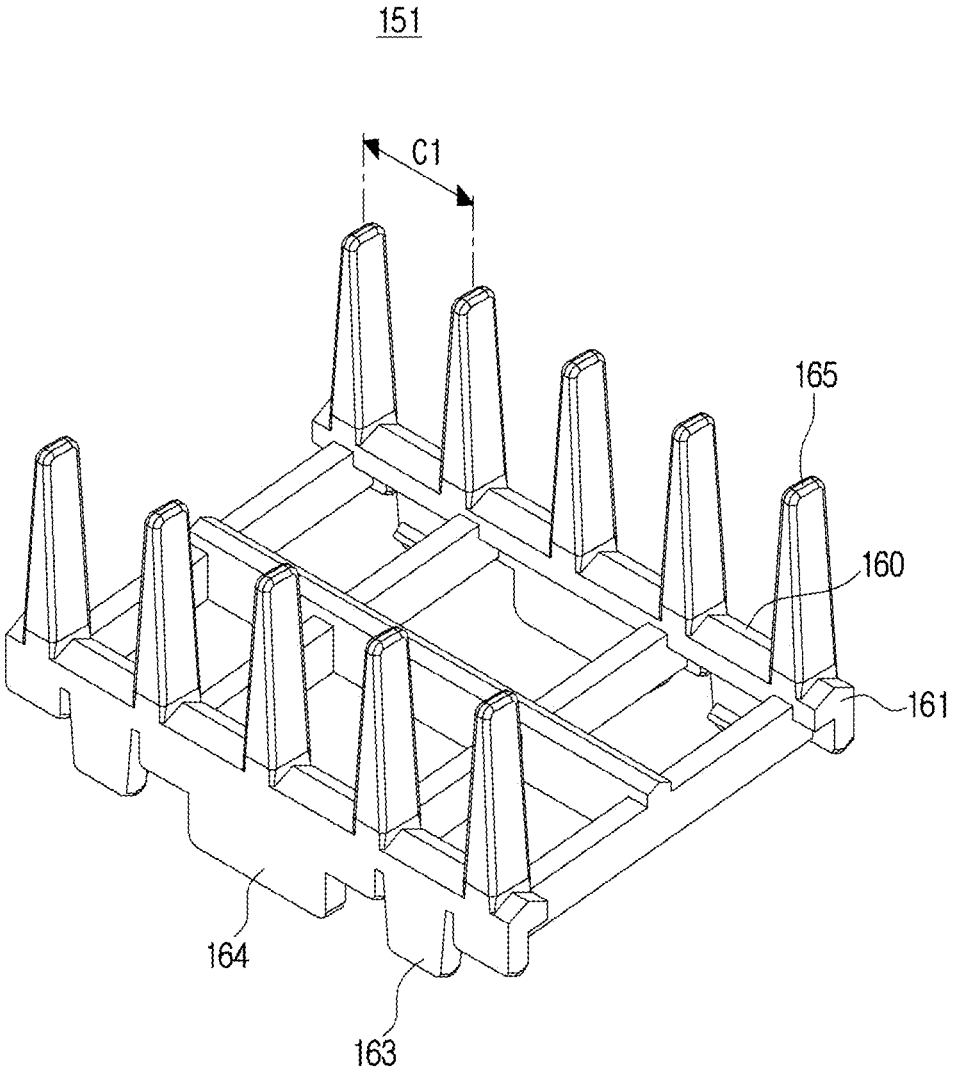
FIG. 4A is a perspective view of a first tine block according to an embodiment of the disclosure.
Figure 4B:
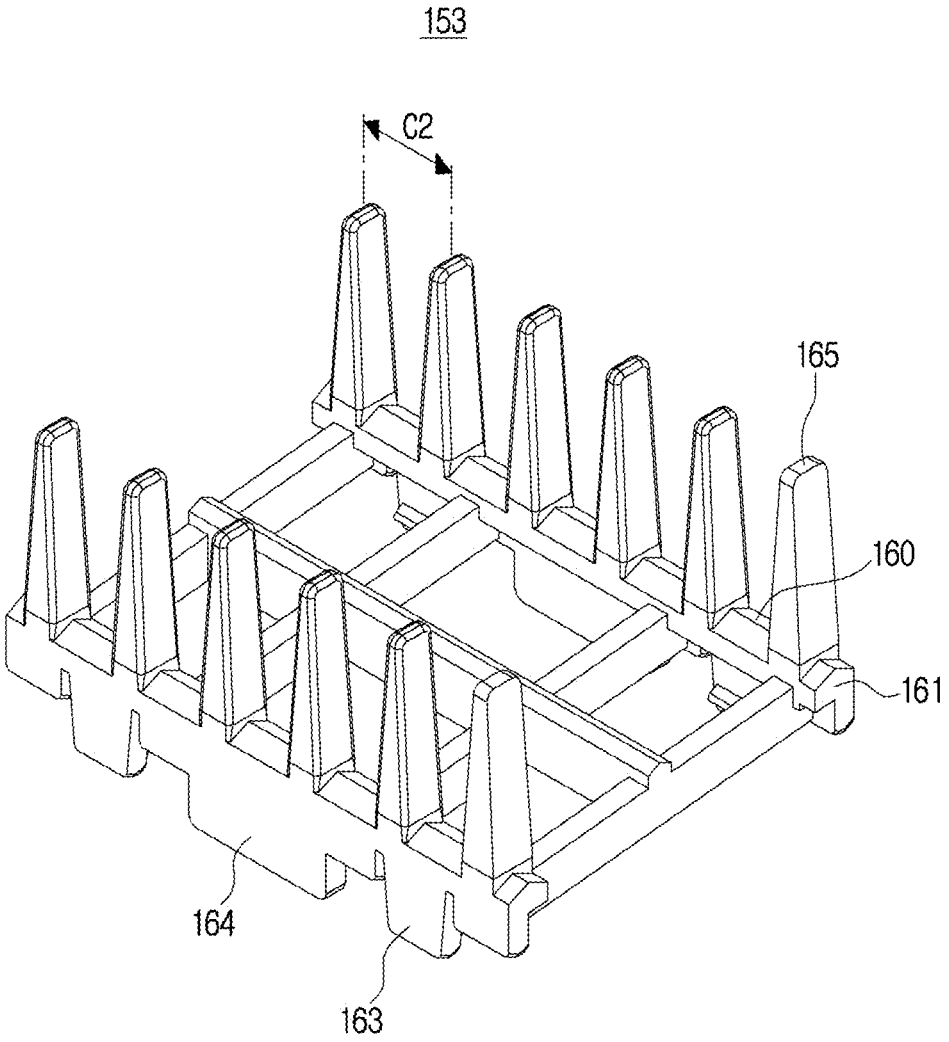
FIG. 4B is a perspective view of a second tine block according to an embodiment of the disclosure.
Figure 4C:
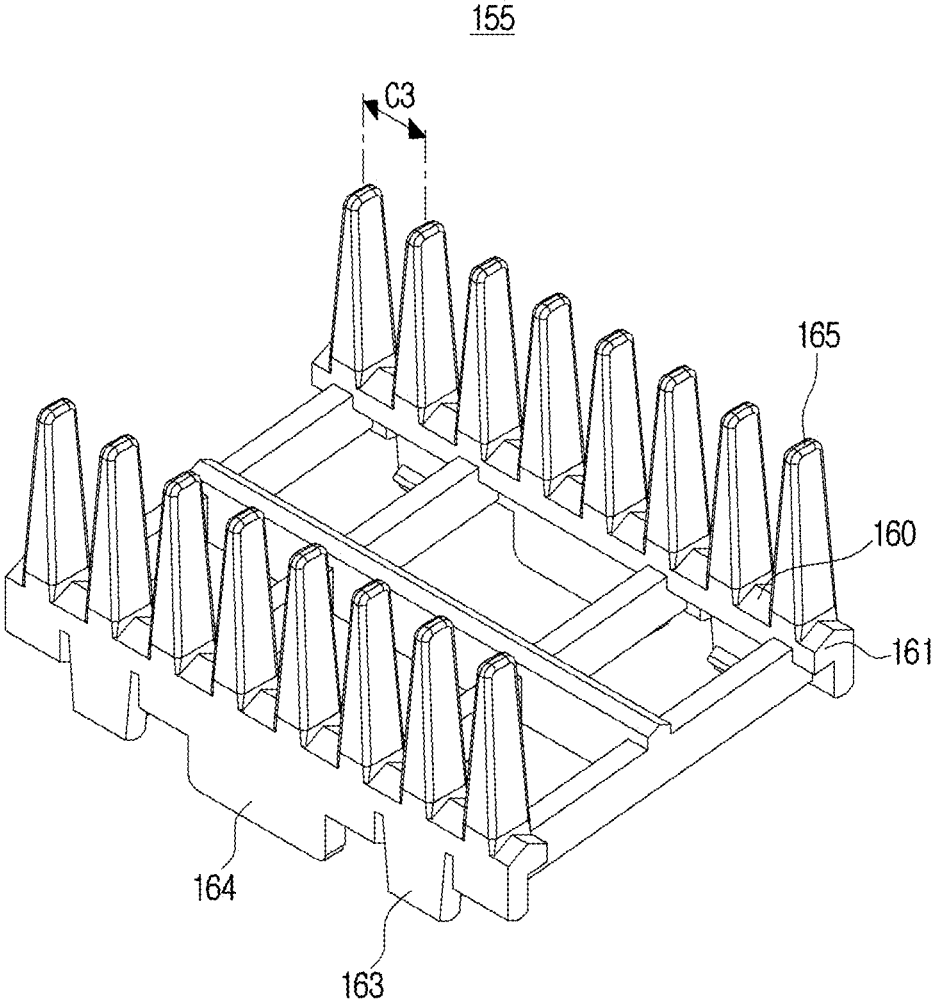
FIG. 4C is a perspective view of a third tine block according to an embodiment of the disclosure.

FIGS. 4A to 4C are perspective views of the first tine block 151 to the third tine block 155 according to an embodiment of the disclosure.

Referring to FIGS. 4A to 4C, the plurality of tine blocks 150 may respectively include a holding surface 160 and a plurality of tines 165, a hook 163 and a guide member 164. Also, in the respective plurality of tine blocks 150, the intervals by which the plurality of tines 165 are separately arranged may be different.

The holding surface 160 is a surface supporting cutlery, and it may have a shape tilted by a predetermined angle. As the bottom surface of the rack assembly 100 may have a shape tilted by a predetermined angle, in order that cutlery is held on the plurality of tine blocks 150 and is not slipped in a tilted direction, the shape of the holding surface 160 may have a tilted shape correspondingly to the shape of the bottom surface of the rack assembly 100.

The plurality of tines 165 may be separately arranged in the top surface direction of the holding surface 160. The plurality of tines 165 may be a column shape that is projected and extended in the upper direction so as to support cutlery, and they may be a shape of which width becomes narrower gradually in the upper direction. Also, they may have a shape that is tilted or bent by a predetermined angle.

The height of the plurality of tine blocks 150 may be designed in consideration of the general width of cutlery, and the height of the plurality of tines 165 of one tine block 150 and the height of the plurality of tines 165 of another tine block 150 among the plurality of tine blocks 150 may be different.

In the first tine block 151, the plurality of tines 165 may be separately arranged by the first interval C1, and in the second tine block 153, the plurality of tines 165 may be separately arranged by the second interval C2, and in the third tine block 155, the plurality of tines 165 may be separately arranged by the third interval C3. The first interval to the third interval C1, C2, C3 may be values different from one another.

Specifically, the first interval C1 may be smaller than the second interval C2, and the second interval C2 may be smaller than the third interval C3. The plurality of tines 165 may support the handle part of the cutlery, and the first interval to the third interval C1, C2, C3 may be determined in consideration of the thickness of handles of cutlery sold in the market. Thus, each of the first tine block to the third tine block 151, 153, 155 may stably support cutlery different from one another.

As the width A in the first direction of the plurality of tine blocks 150 may be identical, the number of the plurality of tines 165 included by the first tine block 151 to the third tine block 155 may be different. For example, in the plurality of tine blocks 150 where the width A in the first direction is set as 64 mm, and the width B in the second direction is set as 44 mm identically, the first interval C1 may be designed as 10 mm, the second interval C2 as 7 mm, and the third interval C as 3 mm, and accordingly, each of the first to third tine blocks 151, 153, 155 may include five, six, and eight tines 165.

The third tine block 155 where the intervals among the plurality of tines 165 are narrow may support a greater amount cutlery in relatively small sizes such as tea spoons and dessert forks stably, and the first tine block 151 where the intervals among the plurality of tines 165 are wide may stably support cutlery in relatively larger sizes such as knives, and spoons and forks having thick handles, etc. Thus, a user may couple the plurality of tine blocks 150 to the rack assembly 100 to correspond to the shapes and the number of cutlery to be washed in consideration of his or her own use environment.

The shapes of the plurality of tines 165 of the first tine block 151 and the shapes of the plurality of tines 165 of the second tine block 153 may be different from one another. Specifically, in the respective tine blocks 150, the height or structures, the shapes, etc. of the plurality of tines 165 are different, and accordingly, the types and the shapes of cutlery that can be held vary, and the cutlery can be supported more stably. In particular, there are many cases where a general rack assembly 100 does not include a housing space corresponding to cutlery that is not often used by users, but the rack assembly 100 of the disclosure includes a plurality of tine blocks 150 including a plurality of tines 165 in various structures, and thus the tine blocks may be used by being coupled to a plurality of wires 101 only in use environments where they are needed. Thus, the rack assembly 100 can selectively house cutlery in various shapes depending on needs of a user.

The tine 165 arranged at the end in the first direction among the plurality of tines 165 may be separately arranged by a predetermined interval from the end part 161 of the holding surface 160. Accordingly, between the plurality of tines 165 continuously arranged, cutlery may be held. Such a configuration will be described in detail with reference to FIG. 5.

The hook 163 may be detachable from the plurality of wires 101. The hook 163 may exist as a plurality of hooks 163, and the plurality of hooks 163 may be arranged to face one another, and they may be formed in an opposite direction to the holding surfaces 160 of the tine blocks 150, and arranged to correspond to the separation intervals of the plurality of wires 101.

When the hooks 163 are coupled to the plurality of wires 101, the guide members 164 may fix the plurality of tine blocks 150 to adhere to the plurality of wires 101. The guide members 164 may be formed among the plurality of hooks 163 in an opposite direction to the holding surfaces 160 of the tine blocks 150, and they may perform a role of making the plurality of tine blocks 150 and the plurality of wires 101 adhere to one another in a state where the plurality of tine blocks 150 are coupled to the plurality of wires 101, and thereby supporting them so as not to be shaken or detached.

Each of the plurality of tine blocks 150 may consist of one body. The plurality of tine blocks 150 should support cutlery stably, and at the same time, in order that shapes of cutlery do not change in a drying cycle, the tine blocks may consist of a material which has high strength and is strong against heat.

Figure 5:
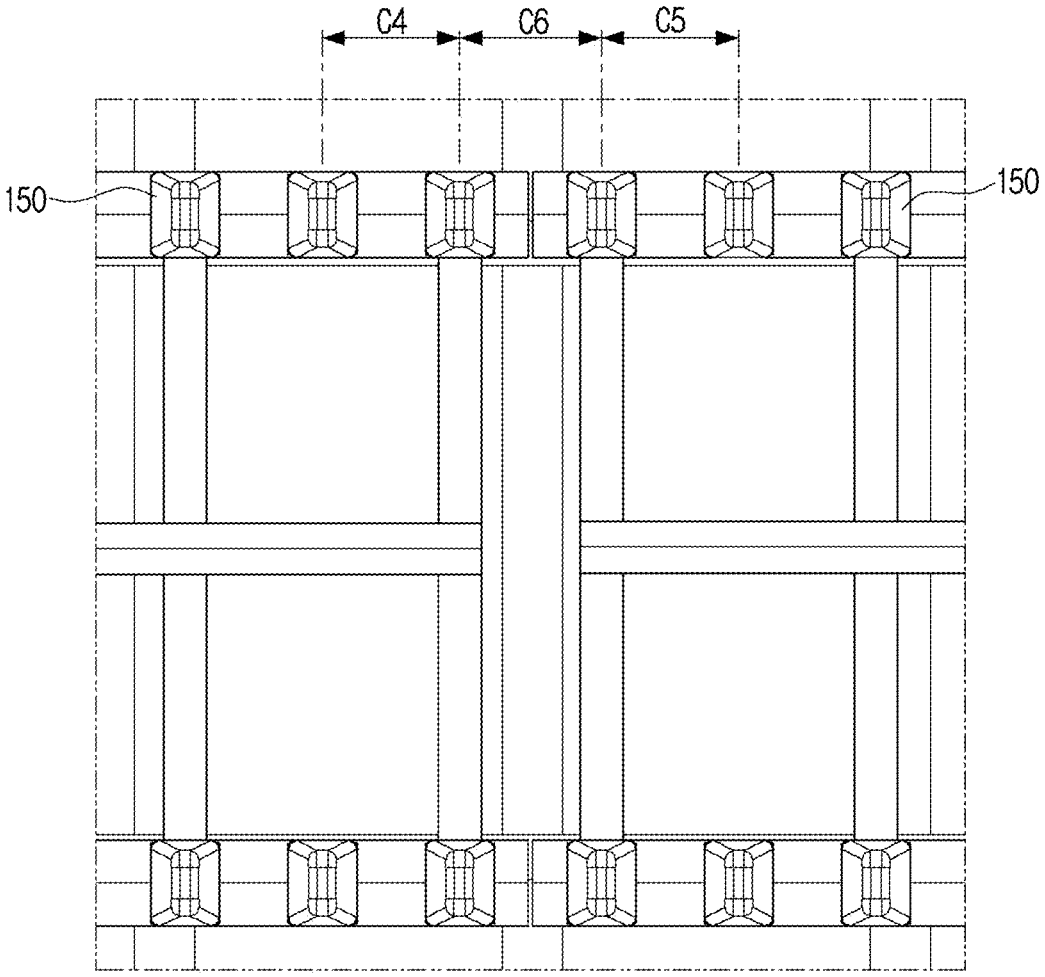
FIG. 5 is an enlarged view of a rack assembly according to an embodiment of the disclosure.

FIG. 5 is an enlarged view of the rack assembly 100 according to an embodiment of the disclosure.

Referring to FIG. 5, holding spaces may be provided between adjacent tine blocks 150 among the plurality of tine blocks 150.

Some tine blocks 150 among the plurality of tine blocks 150 may be adjacently coupled to the plurality of wires 101. In the adjacent two tine blocks 150, the separation intervals of the plurality of tines 165 are respectively a fourth interval C4 and a fifth interval C5, and the fourth interval C4 and the fifth interval C5 may be identical, or the fourth interval C4 and the fifth interval C5 may be different from each other. Also, the fourth interval C4 and the fifth interval C5 may be identical to one of the first to third intervals C1, C2, C3.

The two tines 165 adjacent to the surface that the adjacent tine blocks 150 contact may be separated by a predetermined sixth interval C6. Thus, among the plurality of tines 165 separately arranged by the sixth interval C6, separate cutlery may be additionally held.

According to an embodiment of the disclosure, the fifth interval C5 may be identical to the fourth interval C4, and the sixth interval C6 may also be identical to the fourth interval C4. That is, the two tine blocks 150 where the separation intervals of the tine blocks 150 are identical as the fourth interval C4 may be coupled to the plurality of wires 101 continuously and adjacently, and the adjacent two tines 165 located on the surface that the respective tine blocks 150 contact may also be separated identically to the fourth interval C4. Also, as described above, considering that the tine 165 arranged at the end in the first direction among the plurality of tines 165 is separately arranged by a predetermined interval from the end part 161 of the holding surface 160, the two tines 165 separated by the same interval as the holding surface 160 exist between the two tine blocks 150, and thus a holding space may be provided between the adjacent tine blocks 150. Through such a configuration, the rack assembly 100 can increase the number of cutlery that can be housed.

Figure 6A:
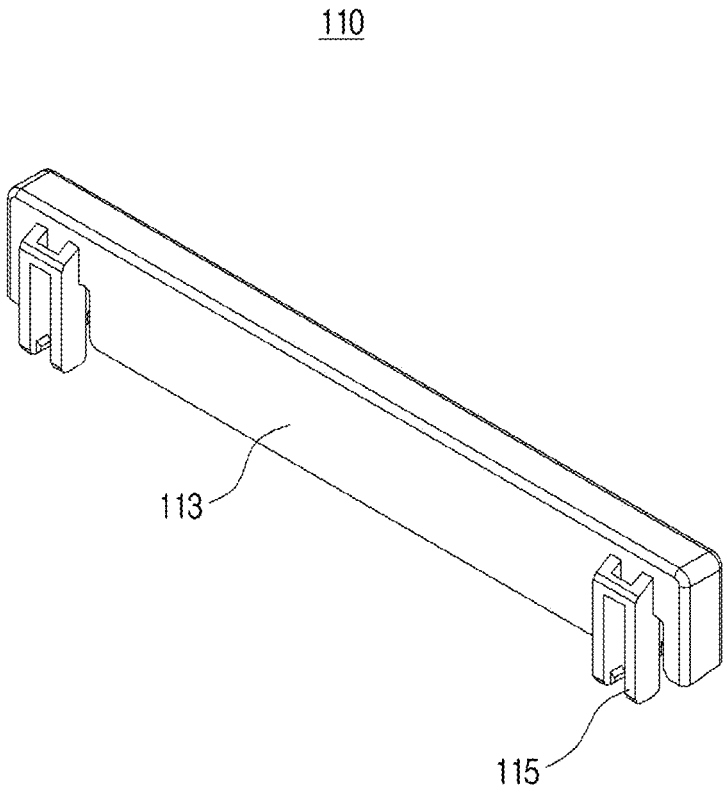
FIG. 6A is a perspective view of a supporting block according to an embodiment of the disclosure.

FIG. 6A is a perspective view of a supporting block 110 according to an embodiment of the disclosure.

Referring to FIG. 6A, the rack assembly 100 may include a supporting block 110.

The supporting block 110 may be detachable from the plurality of wires 101, and it may support cutlery and prevent the cutlery from slipping in the second direction. The supporting block 110 may include a supporting wall 113 supporting cutlery and a hook 115.

As in FIG. 3C, in the rack assembly 100 where at least a part of the bottom surface of the frame 107 has a shape that is tilted in relation to the second direction perpendicular to the first direction, the supporting block 110 may be coupled to the plurality of wires 101 in parallel to the first direction and prevent cutlery from slipping or detaching in the second direction.

The supporting block 110 may be coupled to the lower part of the tilted surface and support cutlery such that the cutlery is not slipped in the lower direction. Alternatively, the supporting block 110 may be coupled to the upper part of the tilted surface and prevent cutlery from slipping or detaching in the upper direction of the tilted surface by movement of washing water or the rack assembly 100 in the second direction. Also, the supporting block 110 may partition the bottom surface in the same manner as the partitioning block 120.

Figure 6B:
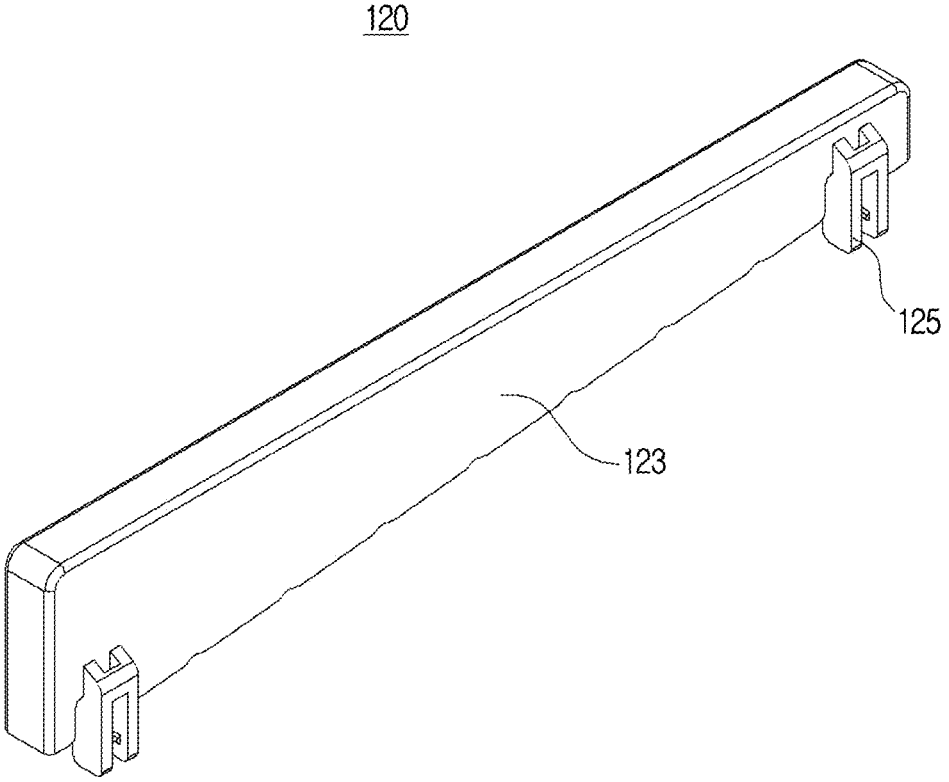
FIG. 6B is a perspective view of a partitioning block according to an embodiment of the disclosure.

FIG. 6B is a perspective view of a partitioning block 120 according to an embodiment of the disclosure.

Referring to FIG. 6B, the rack assembly 100 may include a partitioning block 120.

The partitioning block 120 may be detachable from the plurality of wires 101 and partition the bottom surface of the frame 107. The partitioning block 120 may include a partitioning wall 123 and a hook 125. The partitioning block 120 may be coupled to the plurality of wires 101 in the second direction parallel to the vertical wire 103. The partitioning block 120 may partition an area where cutlery is arranged, and divide spaces where cutlery will be arranged according to the types and the sizes of the cutlery, and thus a user can arrange cutlery by dividing the cutlery intuitively and easily.

As in FIG. 3C, in the rack assembly 100 where the bottom surface of the frame 107 has a shape where at least a part is tilted in the second direction perpendicular to direction, the partitioning wall 123 of the partitioning block 120 has a shape corresponding to the tilted shape of the rack assembly 100, and accordingly, the upper surface may be horizontal when coupled to the rack assembly 100.

Figure 6C:
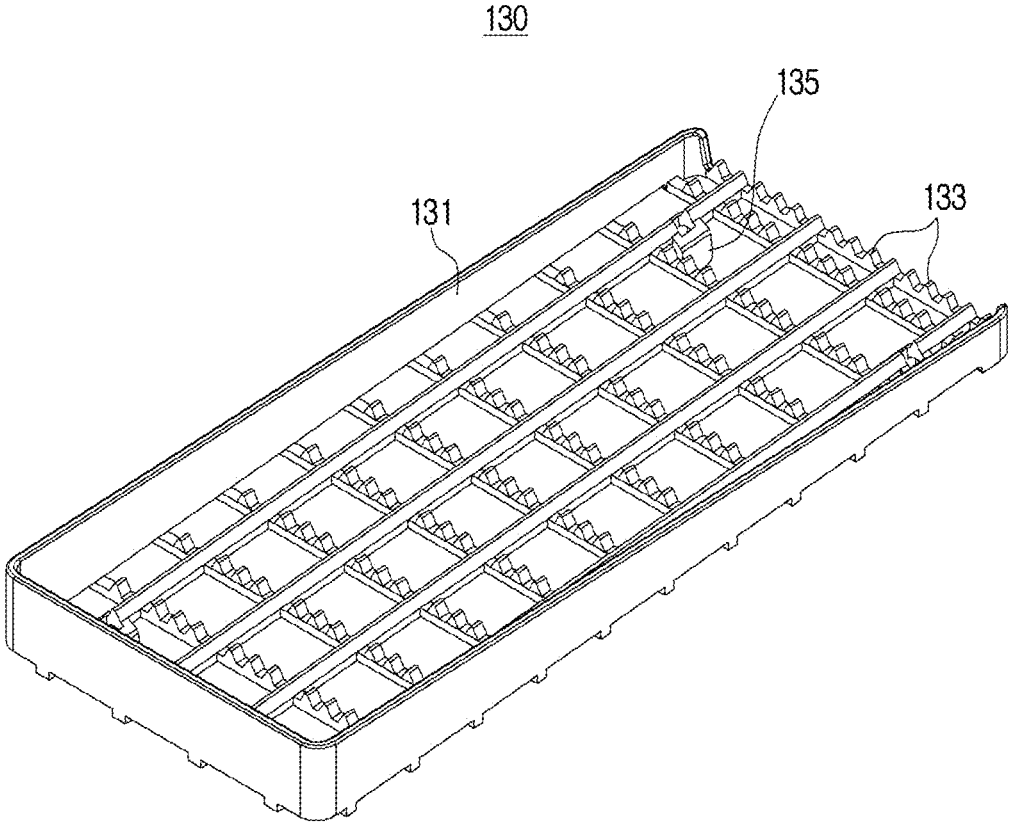
FIG. 6C is a perspective view of a small basket according to an embodiment of the disclosure.

FIG. 6C is a perspective view of a small basket 130 according to an embodiment of the disclosure.

Referring to FIG. 6C, the rack assembly 100 may include a small basket 130.

The small basket 130 may be detachable from the plurality of wires 101. The small basket 130 may include a housing 131 that forms the exterior and the small basket is configured to hold an object for washing, a plurality of fixing projections 133 that are continuously arranged in the first direction on the top surface of the housing 131, and a hook 135 arranged on the bottom surface of the housing 131.

Compared to the plurality of tines 165, the plurality of fixing projections 133 of the small basket 130 has a difference that they have low height and are arranged continuously. The housing 131 has a shape where at least a part of the bottom surface is opened, and the small basket 130 may have a shape where, on a supporting wall 113 separated in the second direction, the plurality of fixing projections 133 are continuously arranged in the first direction. In the small basket 130, the plurality of fixing projections 133 are continuously arranged, and there may be more supporting points contacting cutlery than the plurality of tine blocks 150. Accordingly, various objects for washing in types different from the plurality of tine blocks 150 such as chopsticks, small sauce plates, and small caps can be housed.

Figure 6D:
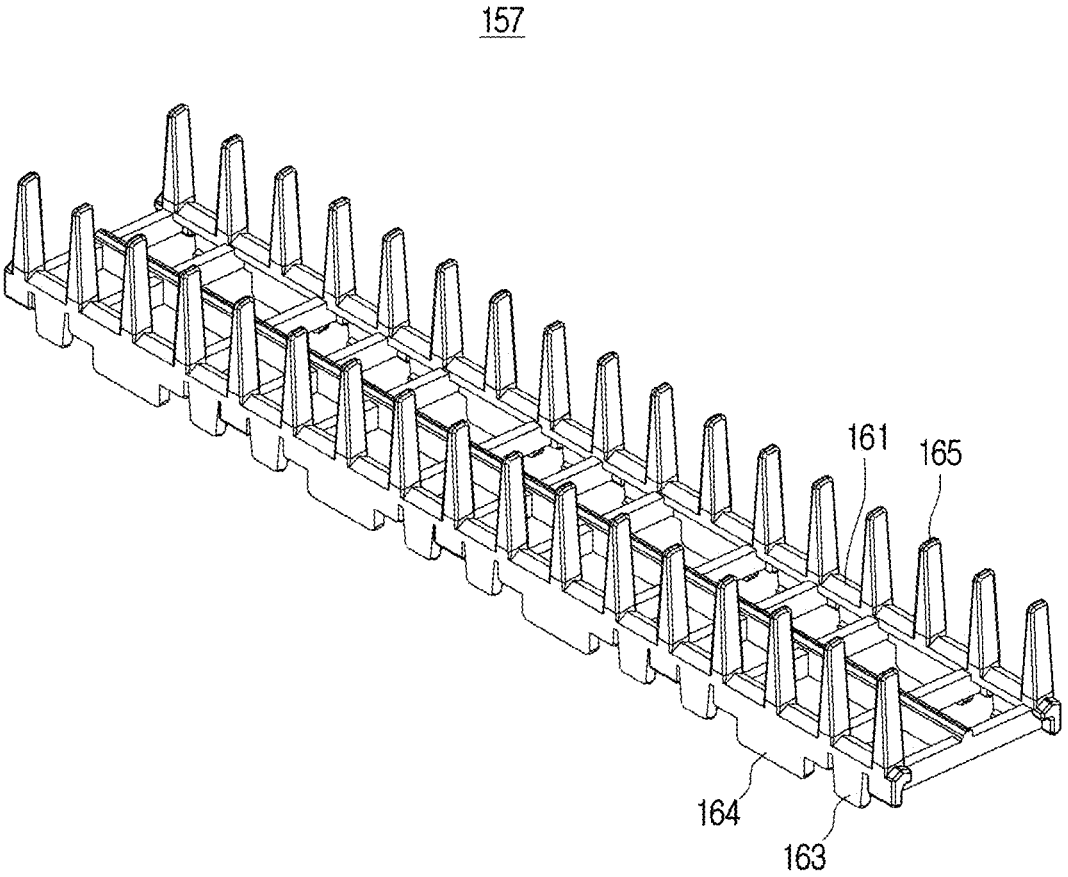
FIG. 6D is a perspective view of a fourth tine block according to an embodiment of the disclosure.

FIG. 6D is a perspective view of a fourth tine block 157 according to an embodiment of the disclosure.

Referring to FIG. 6D, the plurality of tine blocks 150 may include a fourth tine block 157.

The fourth tine block 157 is a tine block 150 for supporting cutlery in types that are generally used by users a lot, and in the fourth tine block 157, the plurality of tines 165 may be separately arranged by one interval among the first interval C1 to the third interval C3, and a width in the first direction may be long to support more cutlery than the other tine blocks 150. Thus, in the fourth tine block 157, the plurality of tines 165 may be separately arranged by the first interval C1 in the first direction, and the width in the first direction may be longer than the width in the first direction of the first tine block 151 based on the bottom surface.

The width in the first direction of the fourth tine block 157 may be integer times of the width in the first direction of the first tine block 151. The fourth tine block 157 may include more hooks 163 and guide members 164 than the other plurality of tine blocks 150, and they may be stably coupled to the plurality of wires 101.

Figure 7:
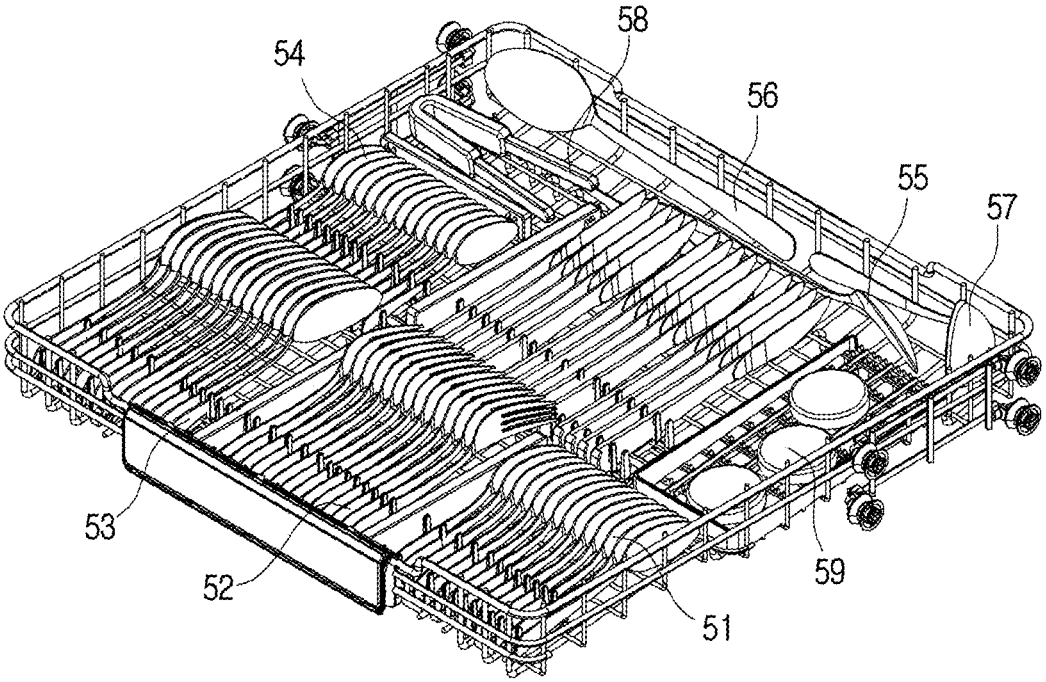
FIG. 7 is a perspective view of a rack assembly according to an embodiment of the disclosure.

FIG. 7 is a perspective view of the rack assembly 100 according to an embodiment of the disclosure.

Referring to FIG. 7, the rack assembly 100 may house cutlery in various types.

The rack assembly 100 includes a plurality of tine blocks 150, a supporting block 110, a partitioning block 120, and a small basket 130, and they are selectively detachable from the plurality of wires 101, and thus a user can freely design the arrangement structure of the rack assembly 100 correspondingly to his or her own use environment. Cutlery such as tea spoons 51, dessert spoons 54, forks 52, and spoons 53 may be held on the tine blocks 150 having appropriate intervals among the plurality of tines 165 in consideration of their respective widths. Also, a small sauce plate 59 or chopsticks, etc. may be held in the small basket 130, and big size spoons for cooking 55, serving spoons 56, scoops 57, tongs 58, etc. having relatively big volumes may be held in spaces partitioned by the partitioning block 120 and the supporting block 110.

The rack assembly 100 can stably house a maximum number of cutlery in various types correspondingly to a use environment of a user, and a user can change the types and the coupling locations of the plurality of tine blocks 150 considering whether a large or small number of cutlery to be held.

Although the present disclosure has been described with various embodiments, various changes and modifications may be suggested to one skilled in the art. It is intended that the present disclosure encompass such changes and modifications as fall within the scope of the appended claims.

What is claimed is:

1. A rack assembly of a dish washer comprising:

a frame including a plurality of wires separately arranged on a bottom surface of the frame configured to house cutlery; and a plurality of tine blocks detachable from the plurality of wires, each of the plurality of tine blocks respectively includes:

a holding surface to support the cutlery, a plurality of tines formed on the holding surface, and protruding in a third direction from the holding surface, and a plurality of hooks and a guide member formed in a lower portion of the holding surface, and protruding from the holding surface in a fourth direction opposite of the third direction, wherein the holding surface, the plurality of tines, the hook, and the guide member are formed as one body, wherein the plurality of tine blocks comprise:

a first tine block includes a plurality of first tines separately arranged by a first interval in a first direction; and a second tine block includes a plurality of second tines separately arranged by a second interval narrower than the first interval in the first direction, wherein the plurality of hooks is arranged to correspond to separation intervals of the plurality of wires on the bottom surface of the frame and be detachable from the plurality of wires on the bottom surface of the frame.

2. The rack assembly of claim 1, wherein, in the second tine block, a width in the first direction and a width in a second direction perpendicular to the first direction are respectively identical to a width in the first direction and a width in second direction of the first tine block based on the bottom surface.

3. The rack assembly of claim 1, wherein, in the plurality of tine blocks, a tine arranged at an end in the first direction among the plurality of tines is separately arranged by a predetermined interval from an end part of the holding surface.

4. The rack assembly of claim 1, wherein:

the plurality of tine blocks includes adjacent tine blocks coupled to the plurality of wires, and two adjacent tines, on contacting surfaces of the adjacent tine blocks, are separated by the first interval.

5. The rack assembly of claim 1, wherein the guide member is configured to adhere, based on the plurality of hooks being coupled to the plurality of wires on the bottom surface of the frame, to the plurality of wires on the bottom surface of the frame and fix the plurality of tine blocks.

6. The rack assembly of claim 1, wherein shapes of the plurality of first tines of the first tine block are different from shapes of the plurality of second tines of the second tine block.

7. The rack assembly of claim 1, wherein the plurality of tine blocks comprise:

a third tine block including a plurality of third tines separately arranged by a third interval different from the first interval and the second interval in the first direction, and in the third tine block, a width in the first direction and a width in a second direction perpendicular to the first direction are respectively identical to a width in the first direction and a width in the second direction of the first tine block based on the bottom surface.

8. The rack assembly of claim 1, wherein:

at least a part of the bottom surface of the frame has a shape that is tilted in relation to a second direction perpendicular to the first direction, and the rack assembly comprises:

a supporting block detachable from the plurality of wires, and configured to:

support the cutlery, and prevent the cutlery from slipping in the second direction.

9. The rack assembly of claim 1, further comprising:

a partitioning block detachable from the plurality of wires, and configured to partition the bottom surface of the frame.

10. The rack assembly of claim 1, further comprising:

a small basket detachable from the plurality of wires, wherein the small basket comprises:

a housing that forms an outer rim and configured to hold an object for washing; and a plurality of fixing projections continuously arranged in the first direction on a top surface of the housing.

11. The rack assembly of claim 1, wherein the plurality of tine blocks comprise:

a fourth tine block including a plurality of fourth tines separately arranged by the first interval in the first direction, and in the fourth tine block, a width in the first direction is longer than a width in the first direction of the first tine block based on the bottom surface.

12. The rack assembly of claim 1, wherein:

the plurality of tine blocks include a plurality of holding surfaces separately arranged from one another, and the plurality of tines are separately arranged on respective holding surfaces.

13. A dish washer comprising:

a main body;

a washing tub is provided inside of the main body;

an upper basket arranged in an upper end of the washing tub, and includes a frame including a plurality of wires separately arranged on a bottom surface of the frame configured to house cutlery; and a plurality of tine blocks detachable from the plurality of wires, each of the plurality of tine blocks respectively includes:

a holding surface to support the cutlery, a plurality of tines formed on the holding surface, and protruding in a third direction from the holding surface, and a plurality of hooks and a guide member formed in a lower portion of the holding surface, and protruding from the holding surface in a fourth direction opposite of the third direction, wherein the holding surface, the plurality of tines, the hook, and the guide member are formed as one body, wherein the plurality of tine blocks comprise:

a first tine block including a plurality of first tines separately arranged by a first interval in a first direction; and a second tine block includes a plurality of second tines separately arranged by a second interval narrower than the first interval in the first direction, wherein the plurality of hooks is arranged to correspond to separation intervals of the plurality of wires on the bottom surface of the frame and be detachable from the plurality of wires on the bottom surface of the frame.

14. The dish washer of claim 13, wherein, in the second tine block, a width in the first direction and a width in a second direction perpendicular to the first direction are respectively identical to a width in the first direction and a width in the second direction of the first tine block based on a bottom surface of the first and second tine block.

15. The dish washer of claim 13, wherein, in the plurality of tine blocks, a tine arranged at an end in the first direction among the plurality of tines is separately arranged by a predetermined interval from an end part of the holding surface.

16. The dish washer of claim 13, wherein:

the plurality of tine blocks includes adjacent tine blocks coupled to the plurality of wires, and two adjacent tines, on contacting surfaces of the adjacent tine blocks, are separated by the first interval.

17. The dish washer of claim 13, wherein the guide member is configured to adhere, based on the plurality of hooks being coupled to the plurality of wires on the bottom surface of the frame, to the plurality of wires on the bottom surface of the frame and fix the plurality of tine blocks.

18. The dish washer of claim 13, wherein shapes of the plurality of first tines of the first tine block are different from shapes of the plurality of second tines of the second tine block.

19. The dish washer of claim 13, wherein the plurality of tine blocks comprise:

a third tine block including a plurality of third tines separately arranged by a third interval different from the first interval and the second interval in the first direction, and in the third tine block, a width in the first direction and a width in a second direction perpendicular to the first direction are respectively identical to a width in the first direction and a width in the second direction of the first tine block based on a bottom surface of the first and third tine block.

20. The dish washer of claim 13, wherein:

at least a part of a bottom surface of the frame has a shape that is tilted in relation to a second direction perpendicular to the first direction, and the upper basket further comprises:

a supporting block detachable from the plurality of wires, and configured to:

support the cutlery, and prevent the cutlery from slipping in the second direction.

* * * * *